US009037044B2

(12) United States Patent
Oba

(10) Patent No.: US 9,037,044 B2
(45) Date of Patent: May 19, 2015

(54) IMAGE FORMING APPARATUS

(71) Applicant: FUJI XEROX CO., LTD., Tokyo (JP)

(72) Inventor: Shinichi Oba, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/315,894

(22) Filed: Jun. 26, 2014

(65) Prior Publication Data

US 2015/0104214 A1 Apr. 16, 2015

(30) Foreign Application Priority Data

Oct. 10, 2013 (JP) ..... 2013-212805

(51) Int. Cl.
*G03G 15/00* (2006.01)

(52) U.S. Cl.
CPC ..... *G03G 15/757* (2013.01)

(58) Field of Classification Search
CPC ..... G03G 15/757
USPC ..... 399/167
See application file for complete search history.

(56) References Cited

U.S. PATENT DOCUMENTS 8,351,827 B2 * 1/2013 Yoshii ..... 399/254
8,903,277 B2 * 12/2014 Ishida et al. ..... 399/167
2011/0091237 A1 4/2011 Suzuki

FOREIGN PATENT DOCUMENTS

JP A-2011-90040 5/2011
JP A-2011-197294 10/2011

* cited by examiner

*Primary Examiner* — Hoang Ngo
(74) *Attorney, Agent, or Firm* — Oliff PLC

(57) ABSTRACT

An image forming apparatus includes image bearing members that bear formed images; a driving source that rotationally drives the image bearing members and whose rotational direction is switchable between a first direction and a second direction; a first driving-force transmitting unit that transmits a rotational driving force of the driving source rotationally driven in the first direction as a unidirectional rotational driving force to the image bearing members; and a second driving-force transmitting unit that transmits a rotational driving force of the driving source rotationally driven in the second direction as a unidirectional rotational driving force to one or more of the image bearing members and does not transmit the rotational driving force to a remaining one or more of the image bearing members. The first and second driving-force transmitting units are switched therebetween by changing the rotational direction of the driving source.

7 Claims, 7 Drawing Sheets

IMAGE FORMING APPARATUS

CROSS-REFERENCE TO RELATED APPLICATIONS

This application is based on and claims priority under 35 USC 119 from Japanese Patent Application No. 2013-212805 filed Oct. 10, 2013.

BACKGROUND

Technical Field

The present invention relates to image forming apparatuses.

SUMMARY

According to an aspect of the invention, there is provided an image forming apparatus including multiple image bearing members that bear formed images, a driving source that rotationally drives the multiple image bearing members and whose rotational direction is switchable between a first direction and a second direction, a first driving-force transmitting unit, and a second driving-force transmitting unit. The first driving-force transmitting unit transmits a rotational driving force of the driving source rotationally driven in the first direction as a unidirectional rotational driving force to the multiple image bearing members. The second driving-force transmitting unit transmits a rotational driving force of the driving source rotationally driven in the second direction as a unidirectional rotational driving force to one or more of the multiple image bearing members and does not transmit the rotational driving force to a remaining one or more of the multiple image bearing members. The first and second driving-force transmitting units are switched therebetween by changing the rotational direction of the driving source.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

First Exemplary Embodiment

Figure 1:
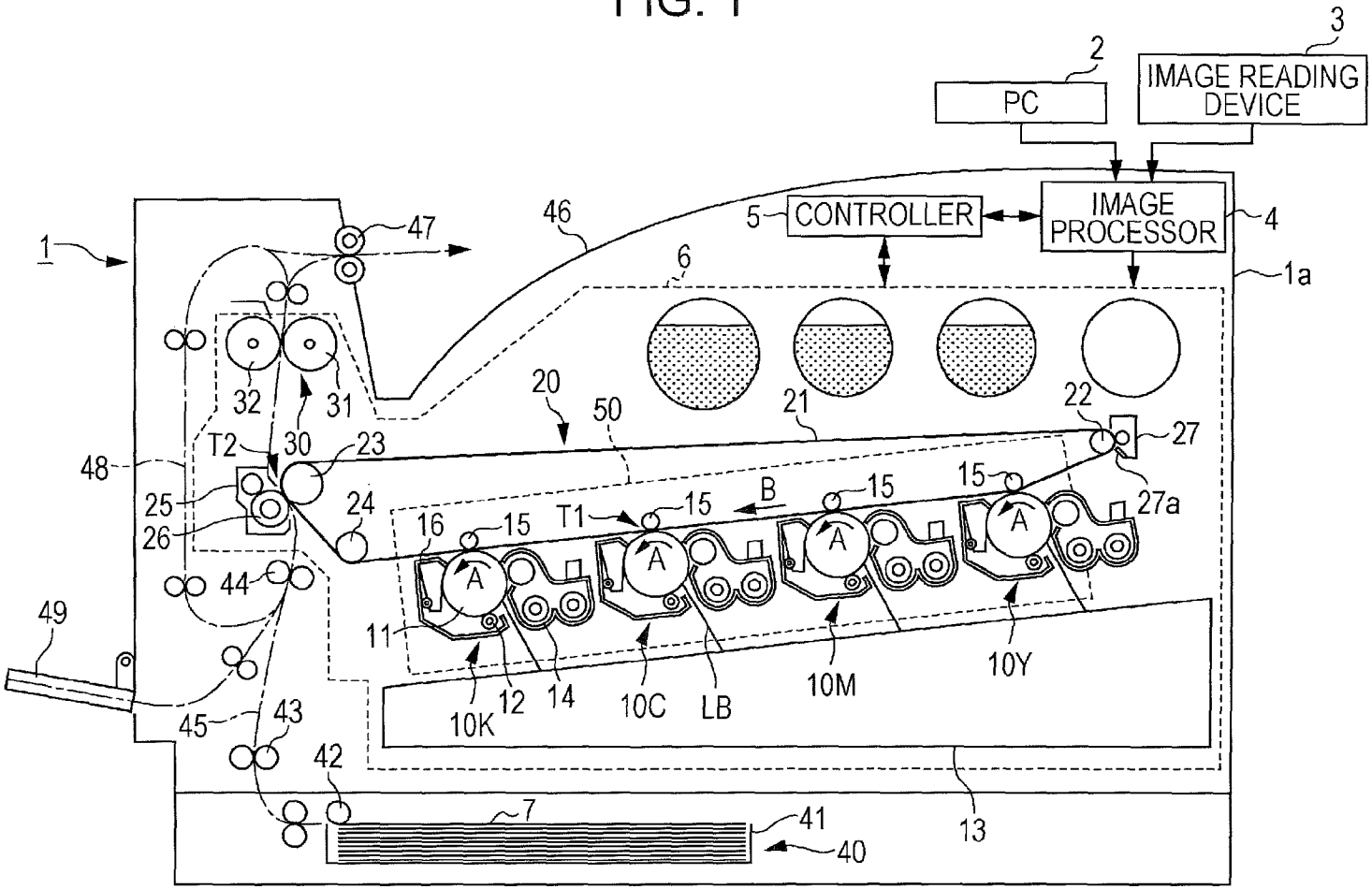
FIG. 1 schematically illustrates the configuration of an image forming apparatus according to a first exemplary embodiment of the present invention.

FIG. 1 schematically illustrates the overall configuration of an image forming apparatus according to a first exemplary embodiment.

Overall Configuration of Image Forming Apparatus

An image forming apparatus 1 according to the first exemplary embodiment is a color printer. The image forming apparatus 1 receives image data from, for example, a personal computer (PC) 2 or an image reading device 3.

As shown in FIG. 1, the image forming apparatus 1 has a housing la in which an image processor 4 and a controller 5 are disposed. Where appropriate, the image processor 4 performs predetermined image processing on the image data transmitted from, for example, the PC 2 or the image reading device 3. Examples of the predetermined image processing include shading correction, misregistration correction, brightness/color-space conversion, gamma correction, frame deletion, and color/movement edition. The controller 5 controls the overall operation of the entire image forming apparatus 1.

The image data having undergone the predetermined image processing at the image processor 4 is converted into image data for four colors, namely, yellow (Y), magenta (M), cyan (C), and black (K) colors, by the image processor 4, and is output as a full-color image or a monochrome image by an image output unit 6 provided within the image forming apparatus 1. This will be described below.

The image output unit 6 includes multiple image forming devices 10 that form toner images to be developed with toners that constitute developers, an intermediate transfer device 20 that bears the toner images formed by the image forming devices 10 and transports the toner images to a second-transfer position T2 where the toner images are ultimately second-transferred onto recording paper 7 as an example of a recording medium, and a fixing device 30 that fixes the toner images second-transferred on the recording paper 7 by the intermediate transfer device 20 onto the recording paper 7. Furthermore, a paper feed device 40 that accommodates therein and transports a desired number of recording paper 7 to be supplied to the second-transfer position T2 of the intermediate transfer device 20 is provided in combination with the image output unit 6. The housing 1*a* is formed of, for example, a support structure member or an outer cover.

The image forming devices 10 include four image forming devices 10Y, 10M, 10C, and 10K that dedicatedly form yellow (Y), magenta (M), cyan (C), and black (K) toner images, respectively. The four image forming devices 10 (Y, M, C, and K) are arranged in a single line within the housing 1*a*.

As shown in FIG. 1, the image forming devices 10 (Y, M, C, and K) each include a photoconductor drum 11 as an example of a rotatable image bearing member. The photoconductor drum 11 is surrounded by the following devices. Such devices include a charging device 12 that electrostatically charges an image-formable peripheral surface (i.e., image bearing surface) of the photoconductor drum 11 to a predetermined potential; an exposure device 13 as an exposure unit that radiates a light beam LB based on image information (signal) onto the electrostatically-charged peripheral surface of the photoconductor drum 11 so as to form an electrostatic latent image (of the corresponding color) with a potential difference; a developing device 14 (Y, M, C, or K) as a developing unit that develops the electrostatic latent image into a toner image by using the toner of the developer of the corresponding color (Y, M, C, or K); a first-transfer device 15 that transfers the toner image onto the intermediate transfer device 20 at a first-transfer position T1; and a drum cleaning device 16 that performs cleaning by removing extraneous matter, such as residual toner, from the image bearing surface of the photoconductor drum 11 after the first-transfer process.

Each photoconductor drum 11 is formed by forming an image bearing surface having a photoconductive layer (photosensitive layer) composed of a photosensitive material around the peripheral surface of a cylindrical or columnar base material, which is connected to ground. The photoconductor drum 11 is supported in a rotatable manner in a direction indicated by an arrow A by receiving a driving force from a driving device 50, which will be described later.

Each charging device 12 is constituted of a contact-type charging roller that is disposed in contact with the photoconductor drum 11. The charging device 12 is supplied with charge voltage. In a case where the developing device 14 is configured to perform reversal development, the supplied charge voltage is a voltage or current with the same polarity as the charge polarity of the toner supplied from the developing device 14.

The exposure device 13 radiates light beams LB in accordance with image information input to the image forming apparatus 1 onto the electrostatically-charged peripheral surfaces of the photoconductor drums 11 so as to form electrostatic latent images thereon. When a latent-image forming process is to be performed, image information (signal) input to the image forming apparatus 1 via an arbitrary unit and processed by the image processor 4 is transmitted to the exposure device 13.

Figure 2:
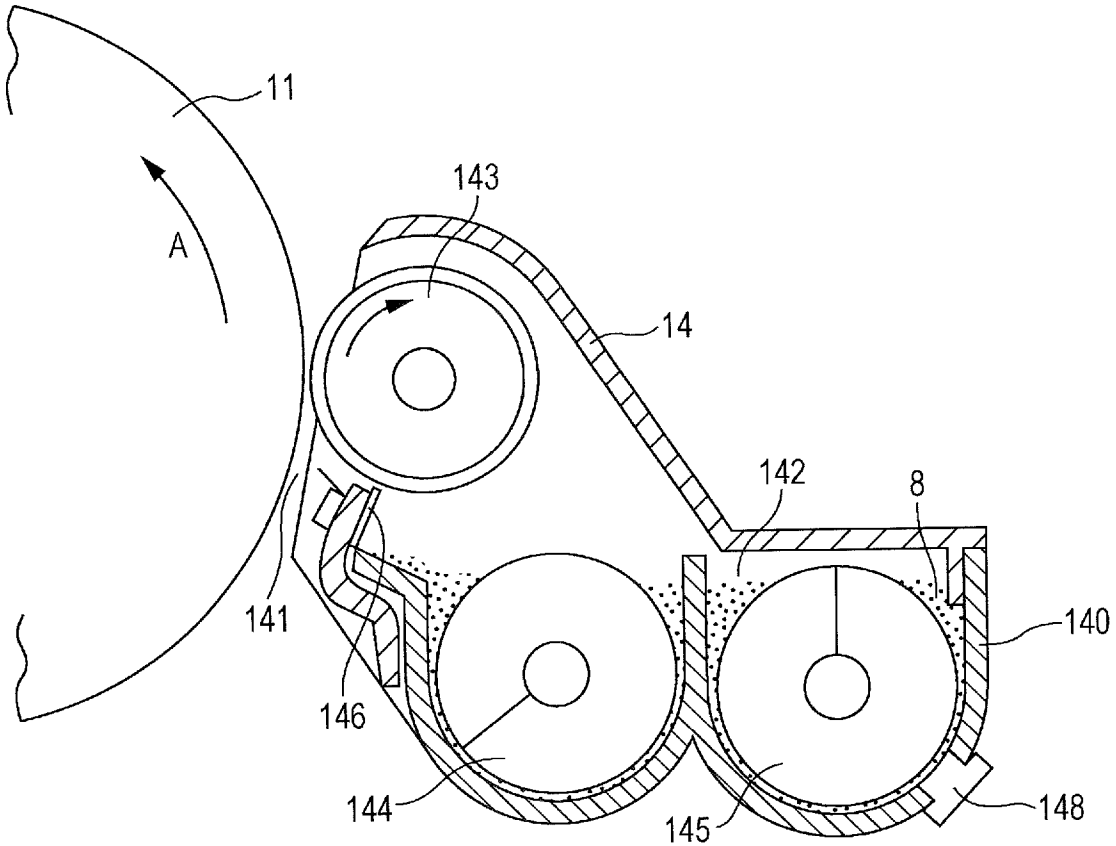
FIG. 2 illustrates the configuration of a developing device of the image forming apparatus according to the first exemplary embodiment of the present invention.

As shown in FIG. 2, each developing device 14 (Y, M, C, or K) has a housing 140 having an opening 141 and an accommodation chamber 142 for a developer 8. The housing 140 accommodates therein, for example, a developing roller 143 that holds the developer 8 and transports the developer 8 to a developing region that faces the photoconductor drum 11, two stirrer transport members 144 and 145, such as screw augers, which transport and supply the developer 8 to the developing roller 143 while stirring the developer 8, and a layer-thickness regulating member 146 that regulates the amount (layer thickness) of the developer 8 held by the developing roller 143. The developing device 14 is supplied with development bias voltage between the developing roller 143 and the photoconductor drum 11 from a power supply device (not shown). Furthermore, the developing roller 143 and the stirrer transport members 144 and 145 receive a driving force from the driving device (not shown) so as to rotate in a predetermined direction. Each of the four-color developers 8 (Y, M, C, and K) used above is a two-component developer containing a nonmagnetic toner and a magnetic carrier.

Each first-transfer device 15 is a contact-type transfer device including a first-transfer roller that rotates by coming into contact with the peripheral surface of the photoconductor drum 11 via an intermediate transfer belt 21 and that is supplied with first-transfer voltage. The first-transfer voltage is a direct-current voltage with a reversed polarity relative to the charge polarity of the toner and is supplied from a power supply device (not shown).

Each drum cleaning device 16 is constituted of, for example, a container body having an opening in a part thereof, a cleaning plate that cleans the peripheral surface of the photoconductor drum 11 after the first-transfer process by coming into contact therewith with predetermined pressure so as to remove extraneous matter, such as residual toner, therefrom, and a collecting device that collects the extraneous matter removed by the cleaning plate.

As shown in FIG. 1, the intermediate transfer device 20 is disposed at a position above the image forming devices 10 (Y, M, C, and K). The intermediate transfer device 20 includes the intermediate transfer belt 21 that rotates in a direction indicated by an arrow B while passing through the first-transfer positions T1 between the photoconductor drums 11 and the first-transfer devices 15 (first-transfer rollers); multiple belt support rollers 22 to 24 that rotatably support the intermediate transfer belt 21 from the inner surface thereof so as to maintain the intermediate transfer belt 21 in a desired state; a second-transfer device 25 that is disposed adjacent to the outer peripheral surface (image bearing surface) of the intermediate transfer belt 21 supported by the belt support roller 23 and that second-transfers the toner images on the intermediate transfer belt 21 onto the recording paper 7; and a belt cleaning device 27 that performs cleaning by removing extraneous matter, such as residual toner and paper particles, from the outer peripheral surface of the intermediate transfer belt 21 after passing through the second-transfer device 25.

The intermediate transfer belt 21 is an endless belt composed of, for example, a material obtained by dispersing a resistance adjustor, such as carbon black, in synthetic resin, such as polyimide resin or polyamide resin. The belt support roller 22 serves as a driven roller, the belt support roller 23 serves as a driving roller as well as a second-transfer backup roller, and the belt support roller 24 serves as a tension-applying roller. The belt support roller 23 serving as a driving roller is rotationally driven by the driving device 50, which will be described later.

As shown in FIG. 1, the second-transfer device 25 is a contact-type transfer device including a second-transfer roller 26 that is supplied with second-transfer voltage and that rotates by coming into contact with the peripheral surface of the intermediate transfer belt 21 at the second-transfer position T2, which is an outer peripheral area of the intermediate transfer belt 21 supported by the belt support roller 23 in the intermediate transfer device 20. The second-transfer voltage supplied to the second-transfer roller 26 or the belt support roller 23 of the intermediate transfer device 20 is a direct-current voltage with a reversed polarity relative to or the same polarity as the charge polarity of the toners.

The belt cleaning device 27 includes a cleaning blade 27*a* as an example of a cleaning member that comes into contact with the surface of the intermediate transfer belt 21. The cleaning blade 27*a* cleans the outer peripheral surface of the intermediate transfer belt 21 by removing extraneous matter, such as residual toner and paper particles, therefrom.

The fixing device 30 includes, for example, a roller-type or belt-type heating rotatable member 31 whose surface temperature is heated to and maintained at a predetermined temperature by a heating unit, and a roller-type or belt-type pressing rotatable member 32 that rotates by being in contact with the heating rotatable member 31 with predetermined pressure. In the fixing device 30, a contact area where the heating rotatable member 31 and the pressing rotatable member 32 are in contact with each other serves as a fixing-process section where a predetermined fixing process (i.e., heating and pressing) is performed.

The paper feed device 40 is disposed at a position below the exposure device 13. The paper feed device 40 includes a single paper accommodation body (or multiple paper accommodation bodies) 41 that accommodates recording paper 7 of a desired size and type in a stacked fashion, and a feed device 42 that feeds the recording paper 7 in a sheet-by-sheet fashion from the paper accommodation body 41. The paper accommodation body 41 is attached in an ejectable manner toward the front surface (i.e., a side surface facing a user during user's operation) of the housing 1*a*.

Multiple pairs of paper transport rollers 43 and 44, which transport the recording paper 7 fed from the paper feed device 40 toward the second-transfer position T2, and a feed transport path 45 constituted of transport guide members are provided between the paper feed device 40 and the second-transfer device 25. The pair of paper transport rollers 44 disposed immediately before the second-transfer position T2 in the feed transport path 45 serves as, for example, rollers (registration rollers) that adjust the transport timing of the recording paper 7. Furthermore, a pair of discharge rollers 47 that discharge the recording paper 7 toward an output accommodation section 46 is disposed downstream of the fixing device 30 in the paper transport direction.

In FIG. 1, reference character 48 denotes a duplex transport path, and reference character 49 denotes a manual feed device.

The image forming apparatus 1 according to this exemplary embodiment has a full-color mode (first mode) and a monochrome mode (second mode) that are switch-controlled by the controller 5. In the full-color mode, an image is formed by using the yellow (Y), magenta (M), cyan (C), and black (K) image forming devices 10 (Y, M, C, and K). In the monochrome mode, an image is formed by using the black (K) image forming device 10K alone. In the full-color mode, the photoconductor drums 11 of all the image forming devices 10 (Y, M, C, and K) come into contact with the intermediate transfer belt 21. On the other hand, in the monochrome mode, only the photoconductor drum 11 of the black (K) image forming device 10K comes into contact with the intermediate transfer belt 21, whereas the photoconductor drums 11 for the remaining colors (Y, M, and C) are disposed away from the intermediate transfer belt 21.

Figure 3A:
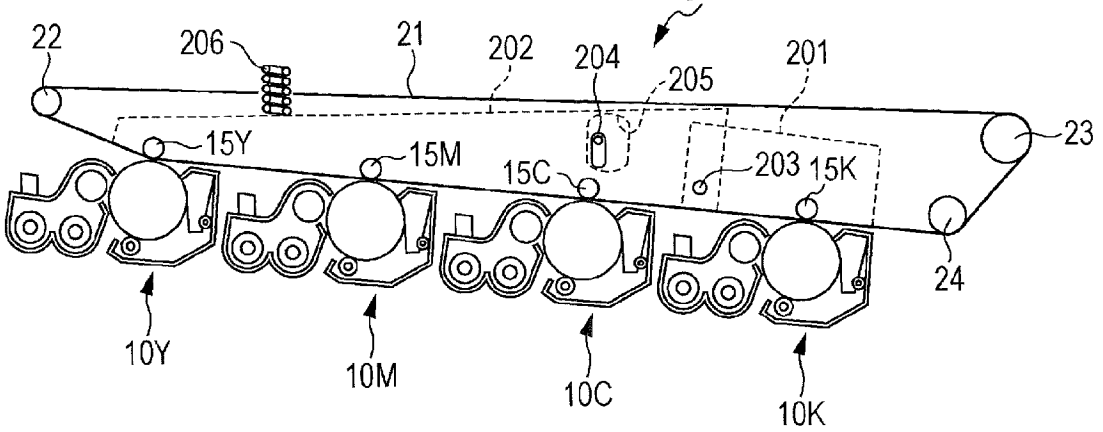
FIGS. 3A and 3B illustrate the configuration of a relevant part of the image forming apparatus according to the first exemplary embodiment of the present invention.

Therefore, as shown in FIG. 3A, the intermediate transfer device 20 includes a first support member 201 that rotatably supports the first-transfer roller 15K of the black (K) image forming device 10K and a second support member 202 that rotatably supports the first-transfer rollers 15 (Y, M, and C) of the yellow, magenta, and cyan image forming devices 10 (Y, M, and C). The second support member 202 is disposed in a rotatable (tiltable) manner about a fulcrum shaft 203 such that the intermediate transfer belt 21 is movable away from the photoconductor drums 11 (Y, M, and C) together with the first-transfer rollers 15 (Y, M, and C). The second support member 202 includes an eccentric cam 204 that is rotationally driven by the driving device (not shown), a recess 205 that allows the second support member 202 to rotate via the eccentric cam 204, and a coil spring 206 that presses the second support member 202 toward the image forming devices 10 (Y, M, and C).

Basic Operation of Image Forming Apparatus

Basic image forming operation performed by the image forming apparatus 1 will be described below.

The image forming operation described below is performed when forming a full-color image constituted of a combination of four-color (Y, M, C, and K) toner images by using the four image forming devices 10 (Y, M, C, and K).

When the image forming apparatus 1 receives image-formation (print) request command information, the four image forming devices 10 (Y, M, C, and K), the intermediate transfer device 20, the second-transfer device 25, the fixing device 30, and so on are actuated.

In each of the image forming devices 10 (Y, M, C, and K), the photoconductor drum 11 first rotates in the direction of the arrow A, and the charging device 12 electrostatically charges the surface of the photoconductor drum 11 to a predetermined polarity (negative polarity in the first exemplary embodiment) and a predetermined potential. Then, the exposure device 13 radiates light beams LB onto the electrostatically-charged surfaces of the photoconductor drums 11 so as to form electrostatic latent images of the respective color components (Y, M, C, and K) with a predetermined potential difference on the surfaces. Specifically, the light beams LB are emitted based on image signals obtained by the image processor 4 converting image information input to the image forming apparatus 1 from the PC 2, the image reading device 3, or the like into respective color components (Y, M, C, and K).

Subsequently, each of the developing devices 14 (Y, M, C, and K) performs a developing process by supplying and electrostatically adhering the toner of the corresponding color (Y, M, C, or K) electrostatically charged to a predetermined polarity (negative polarity) onto the electrostatic latent image of the corresponding color component formed on the photoconductor drum 11. As a result of this developing process, the electrostatic latent images of the respective color components formed on the photoconductor drums 11 are made into four-color (Y, M, C, and K) visible toner images that have been developed using the toners of the corresponding colors.

Subsequently, when the toner images formed on the photoconductor drums 11 of the image forming devices 10 (Y, M, C, and K) are transported to the respective first-transfer positions T1, the first-transfer devices 15 sequentially first-transfer the toner images onto the intermediate transfer belt 21, rotating in the direction of the arrow B, of the intermediate transfer device 20 in a superimposing manner.

When the first-transfer process is completed in each image forming device 10, the drum cleaning device 16 cleans the surface of the photoconductor drum 11 by scraping off and removing extraneous matter, such as residual toner, from the surface of the photoconductor drum 11. Thus, the image forming devices 10 become ready for subsequent image forming operation.

Subsequently, the intermediate transfer device 20 bears and transports the first-transferred toner images to the second-transfer position T2 by rotating the intermediate transfer belt 21. On the other hand, the paper feed device 40 feeds recording paper 7 to the feed transport path 45 in accordance with the image forming operation. In the feed transport path 45, the pair of paper transport rollers 44 as registration rollers transports and feeds the recording paper 7 to the second-transfer position T2 in accordance with the transfer timing.

At the second-transfer position T2, the second-transfer roller 26 collectively second-transfers the toner images on the intermediate transfer belt 21 onto the recording paper 7. When the second-transfer process is completed in the intermediate transfer device 20, the belt cleaning device 27 cleans the surface of the intermediate transfer belt 21 by removing extraneous matter, such as residual toner, therefrom after the second-transfer process.

Subsequently, the recording paper 7 with the second-transferred toner images is detached from the intermediate transfer belt 21 and the second-transfer roller 26 and is then transported to the fixing device 30. The fixing device 30 performs a fixing process (heating and pressing) so as to fix the unfixed toner images onto the recording paper 7. Finally, the recording paper 7 having undergone the fixing process is discharged by the pair of discharge rollers 47 onto the output accommodation section 46 provided at an upper part of the housing 1*a*.

As a result of the above-described operation, the recording paper 7 having formed thereon a full-color image constituted of a combination of four-color toner images is output.

Figure 3B:
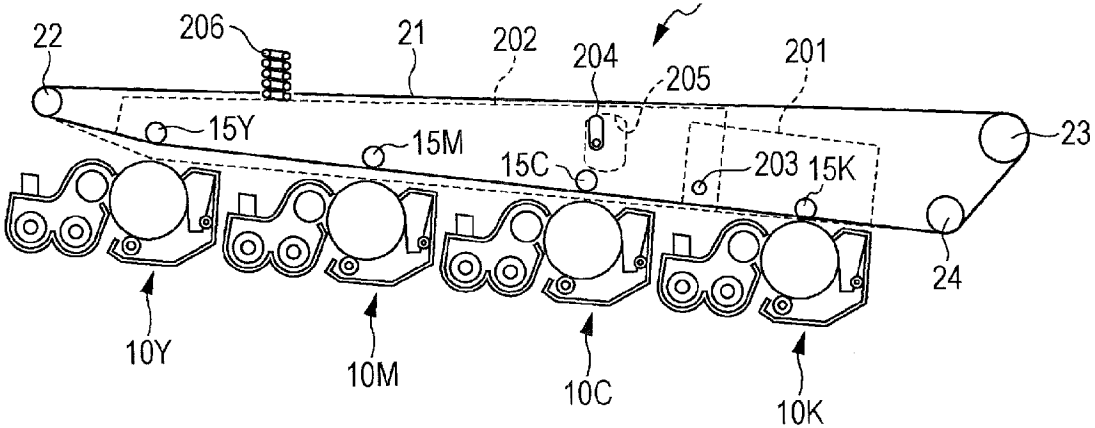

Referring to FIG. 3A, in a case where a monochrome image is to be formed in the image forming apparatus 1, the eccentric cam 204 is rotated counterclockwise by the driving device (not shown). Thus, referring to FIG. 3B, the eccentric cam 204 causes the second support member 202 to rotate clockwise about the fulcrum shaft 203 against the pressing force of the coil spring 206 via the recess 205. Therefore, the intermediate transfer belt 21 moves away from the photoconductor drums 11 of the image forming devices 10 (Y, M, and C) together with the first-transfer rollers 15.

When the intermediate transfer belt 21 moves away from the photoconductor drums 11 of the image forming devices 10 (Y, M, and C), rotational driving of the photoconductor drums 11 and the developing devices 14 stops as described below. In a case where a full-color image is to be formed in the image forming apparatus 1, the eccentric cam 204 is rotated clockwise by the driving device (not shown) in the state shown in FIG. 3B so that the second support member 202 is moved downward by the pressing force of the coil spring 206, thereby bringing the intermediate transfer belt 21 and the first-transfer rollers 15 into contact with the photoconductor drums 11 of the image forming devices 10 (Y, M, and C), as shown in FIG. 3A.

Configuration of Characteristic Part of Image Forming Apparatus

Figure 4A:
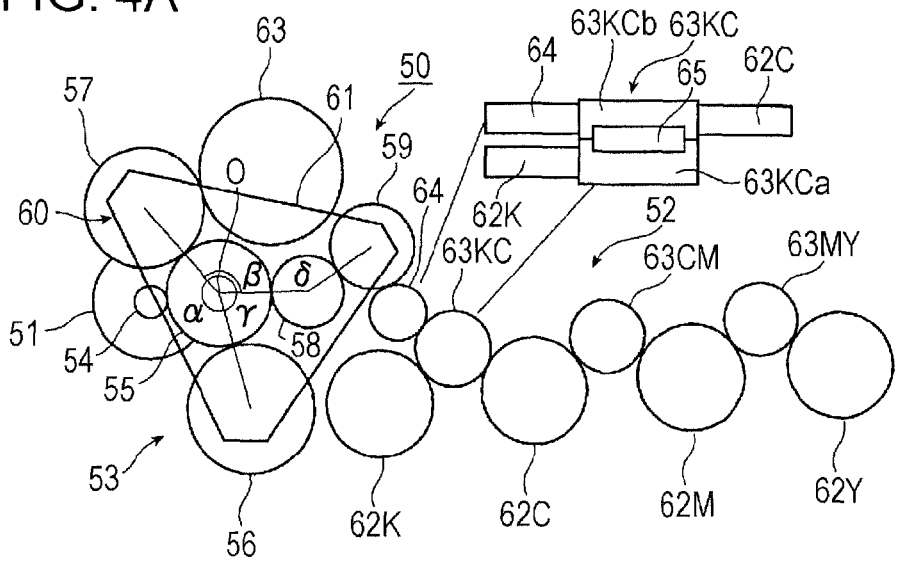
FIGS. 4A to 4C illustrate the configuration of a driving device.
Figure 4B:
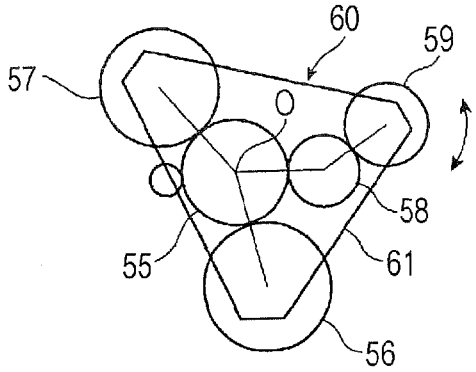
Figure 4C:
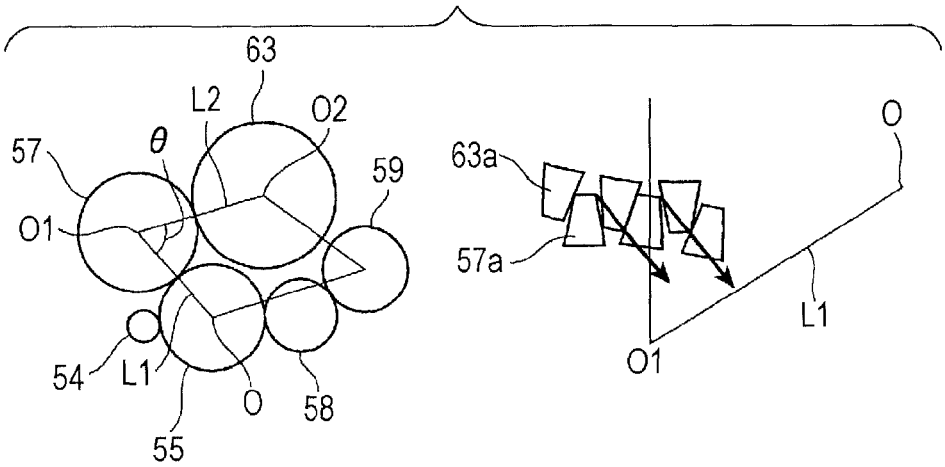

FIGS. 4A to 4C illustrate the configuration of the driving device 50 of the image forming apparatus 1 according to the first exemplary embodiment.

As shown in FIG. 1, the driving device 50 of the image forming apparatus 1 according to the first exemplary embodiment is disposed at the rear side of the housing 1*a*. Referring to FIG. 4A, the driving device 50 includes a driving motor 51 as a driving source attached to a housing (not shown) of the driving device 50. The driving motor 51 is configured such that the rotational direction thereof is switchable between a normal direction (first direction) and a reverse direction (second direction).

The driving device 50 rotationally drives the black photoconductor drum 11K and the belt support roller (driving roller) 23, for driving the intermediate transfer belt 21, constantly in one direction, and is also capable of performing switching whether to rotationally drive or stop the color photoconductor drums 11 (Y, M, and C) in accordance with the image forming mode, i.e., the full-color mode or the monochrome mode.

The driving device 50 includes a first driving-force transmission path 52 as a first driving-force transmitting unit that transmits a driving force to the color photoconductor drums 11 (Y, M, and C) corresponding to multiple colors in addition to the black photoconductor drum 11K and the belt support roller 23 during the full-color mode, and also includes a second driving-force transmission path 53 as a second driving-force transmitting unit that transmits a driving force to the black photoconductor drum 11K, as an example of one of image bearing members, and the belt support roller 23 but does not transmit the driving force to the color photoconductor drums 11 (Y, M, and C) as an example of the remaining image bearing members during the monochrome mode.

A rotational driving force of the driving motor 51 is transmitted to a sun gear 55 via an output gear 54 provided on a rotation shaft of the driving motor 51. The sun gear 55 is rotationally driven about a fixed rotation center O of the driving device 50. The sun gear 55 is meshed with first to third planet gears 56, 57, and 58 having different outside diameters and disposed at positions corresponding to predetermined central angles $\alpha$, $\beta$, and $\gamma$, respectively, around the sun gear 55. Furthermore, a first intermediate gear 59 is meshed with the third planet gear 58 such that a predetermined angle $\delta$ is formed relative to a line that connects the center of the third planet gear 58 and the center of the sun gear 55. The sun gear 55, the first to third planet gears 56, 57, and 58, and the first intermediate gear 59 constitute a gear unit 60 as a gear mechanism. As shown in FIG. 4B, the gear unit 60 is attached to a frame 61 as an example of a substantially triangular frame member such that the gear unit 60 is rotatable in directions indicated by an arrow about the center O of the sun gear 55 in a state where the positional relationship shown in FIG. 4B is maintained. The rotational direction of the frame 61 is changed by switching the rotational direction of the driving motor 51 between the first direction and the second direction. Specifically, when the driving motor 51 is rotationally driven in the clockwise direction, the frame 61 rotates clockwise due to the rotational driving force of the driving motor 51. When the driving motor 51 is rotationally driven in the counterclockwise direction, the frame 61 rotates counterclockwise.

The first planet gear 56 is disposed such that it is selectively meshable with a photoconductor-drum drive gear 62K provided at the black photoconductor drum 11K as the frame 61 of the gear unit 60 rotates. When the gear unit 60 rotates clockwise, the second planet gear 57 selectively meshes with an intermediate-transfer-belt drive gear 63, which rotationally drives the belt support roller 23, so as to rotationally drive the intermediate transfer belt 21. When the gear unit 60 rotates counterclockwise, the third planet gear 58 selectively meshes with the intermediate-transfer-belt drive gear 63, which rotationally drives the belt support roller 23, via the first intermediate gear 59, thereby rotationally driving the intermediate transfer belt 21 in the clockwise direction. Furthermore, when the gear unit 60 rotates clockwise, the third planet gear 58 selectively meshes with a second intermediate gear 64 via the first intermediate gear 59 so as to rotationally drive the black and color photoconductor drums 11 (Y, M, C, and K) in the counterclockwise direction, which will be described below.

Similar to the black photoconductor drum 11K, the color photoconductor drums 11 (Y, M, and C) are equipped with photoconductor-drum drive gears 62 (Y, M, and C) that rotationally drive the color photoconductor drums 11 (Y, M, and C). With regard to these drive gears 62 (Y, M, C, and K) for the black and color photoconductor drums 11 (Y, M, C, and K), the neighboring drive gears 62 (Y, M, C, and K) are linked to each other via transmission gears 63KC, 63CM, and 63MY that transmit a driving force. The transmission gear 63KC located between the black photoconductor drum 11K and the cyan photoconductor drum 11C is meshed with the second intermediate gear 64 disposed at a predetermined position in the driving device 50. As shown in FIG. 4A, the transmission gear 63KC includes two coaxial gears 63KCa and 63KCb. A one-way clutch 65 that only transmits a unidirectional rotational driving force is disposed between the gears 63KCa and 63KCb. In the transmission gear 63KC, the gear 63KCa is meshed with the black photoconductor-drum drive gear 62K, whereas the gear 63KCb is meshed with the second intermediate gear 64 and the cyan photoconductor-drum drive gear 62C.

In accordance with the rotational direction of the output gear 54 of the driving motor 51, the gear unit 60 rotates clockwise or counterclockwise owing to rotation moment occurring between the output gear 54 and the sun gear 55, so as to change the destination to which the rotational driving force from the sun gear 55 is to be transmitted. In the first exemplary embodiment, the sun gear 55, the second planet gear 57, the third planet gear 58, the first intermediate gear 59, the second intermediate gear 64, and the transmission gears 63 constitute the first driving-force transmission path 52. Furthermore, in the first exemplary embodiment, the sun gear 55, the first planet gear 56, the third planet gear 58, and the first intermediate gear 59 constitute the second driving-force transmission path 53. The gears to be meshed within the frame 61 and the gears to be meshed outside the frame 61 in the stopped state change between when a rotational driving force in the first direction is received and when a rotational driving force in the second direction is received, so that the driving-force transmission path is switched between the first and second driving-force transmission paths 52 and 53.

Furthermore, in the first exemplary embodiment, an angle θ formed between a line L1, which connects the center O of the sun gear 55 to a center O1 of the second planet gear 57 that transmits a driving force to the intermediate-transfer-belt drive gear 63, and a line L2, which connects the center O1 of the second planet gear 57 to a center O2 of the intermediate-transfer-belt drive gear 63, is set to 90 degrees or smaller, as shown in FIG. 4C.

Operation of Characteristic Part of Image Forming Apparatus

Figure 5A:
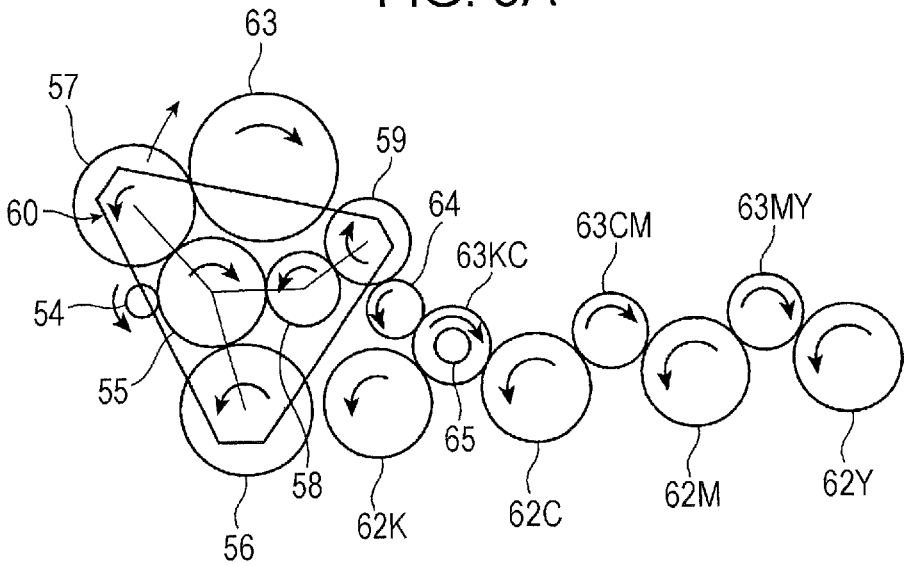
FIGS. 5A and 5B illustrate the operation of the driving device.

In the image forming apparatus 1 according to the first exemplary embodiment, in a case where the full-color mode is selected by the user, the controller 5 sets the rotational direction of the driving motor 51 to the counterclockwise direction (i.e., the first direction) and rotationally drives the driving motor 51. When the driving motor 51 is rotationally driven in the counterclockwise direction, the sun gear 55 meshed with the output gear 54 of the driving motor 51 rotates clockwise, as shown in FIG. 5A, causing the gear unit 60 to also rotate clockwise. As a result, the first planet gear 56 moves away from the black photoconductor-drum drive gear 62K, the second planet gear 57 meshes with the intermediate-transfer-belt drive gear 63, and the first intermediate gear 59 moves away from the intermediate-transfer-belt drive gear 63 and meshes with the second intermediate gear 64.

Therefore, the rotational driving force from the output gear 54 is transmitted to the belt support roller 23 by the intermediate-transfer-belt drive gear 63 via the sun gear 55 and the second planet gear 57, so that the intermediate transfer belt 21 is rotationally driven in the clockwise direction. Furthermore, the black and color photoconductor drums 11 (Y, M, C, and K) are rotationally driven in a specific direction, that is, the counterclockwise direction, via the output gear 54, the sun gear 55, the third planet gear 58, the first and second intermediate gears 59 and 64, and the transmission gears 63KC, 63CM, and 63MY.

Accordingly, the image forming apparatus 1 rotationally drives the driving motor 51 in the counterclockwise direction so as to rotationally drive the black and color photoconductor drums 11 (Y, M, C, and K) and the intermediate transfer belt 21, thereby forming a full-color image.

Figure 5B:
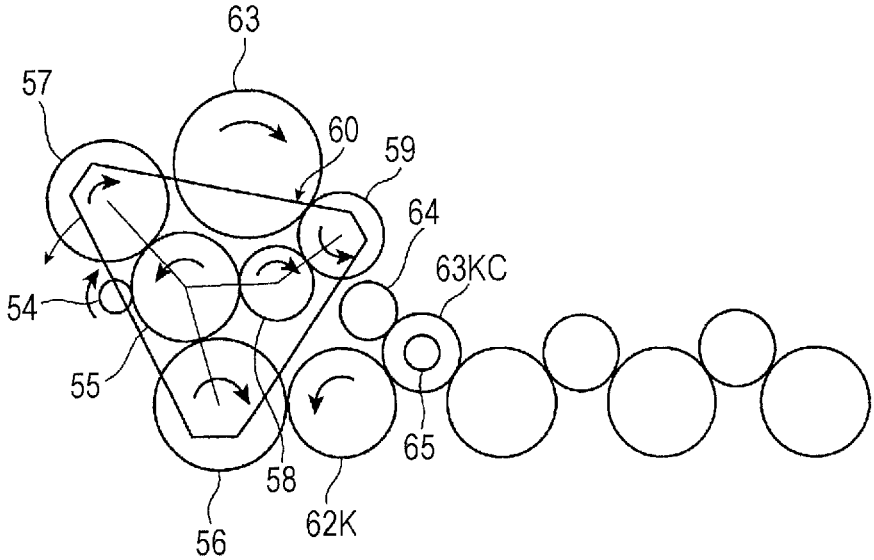

On the other hand, in the image forming apparatus 1, in a case where the monochrome mode is selected by the user, the controller 5 rotationally drives the driving motor 51 in the clockwise direction (i.e., the second direction). By rotationally driving the driving motor 51 in the clockwise direction, the sun gear 55 meshed with the output gear 54 of the driving motor 51 rotates counterclockwise, as shown in FIG. 5B, causing the gear unit 60 (i.e., the frame 61) to also rotate counterclockwise. As a result, the first planet gear 56 meshes with the black photoconductor-drum drive gear 62K, the second planet gear 57 moves away from the intermediate-transfer-belt drive gear 63, and the first intermediate gear 59 moves away from the second intermediate gear 64 and meshes with the intermediate-transfer-belt drive gear 63.

Therefore, the intermediate-transfer-belt drive gear 63 receives the rotational driving force from the output gear 54 via the sun gear 55, the third planet gear 58, and the first intermediate gear 59, so that the intermediate transfer belt 21 is rotationally driven in the clockwise direction. Furthermore, the black photoconductor drum 11K is rotationally driven in the counterclockwise direction directly by the photoconductor-drum drive gear 62K via the output gear 54, the sun gear 55, and the first planet gear 56. On the other hand, with regard to the color photoconductor drums 11 (Y, M, and C), the gear unit 60 rotates counterclockwise so as to cause the first intermediate gear 59 to move away from the second intermediate gear 64, and because the transmission gear 63KC meshed with the black photoconductor-drum drive gear 62K has the one-way clutch 65 built therein, the transmission gear 63KC is in a stopped state due to not receiving the rotational driving force from the black photoconductor-drum drive gear 62K.

Accordingly, the image forming apparatus 1 rotationally drives the driving motor 51 in the clockwise direction so as to rotationally drive the black photoconductor drum 11K and the intermediate transfer belt 21, thereby forming a monochrome image.

Furthermore, in the first exemplary embodiment, the angle θ formed between the line L1, which connects the center O of the sun gear 55 to the center O1 of the second planet gear 57 that transmits a driving force to the intermediate-transfer-belt drive gear 63, and the line L2, which connects the center O1 of the second planet gear 57 to the center O2 of the intermediate-transfer-belt drive gear 63, is set to 90 degrees or smaller, as shown in FIG. 4C. Therefore, until the second planet gear 57 of the gear unit 60 moves away from the intermediate-transfer-belt drive gear 63 and the first intermediate gear 59 meshes with the intermediate-transfer-belt drive gear 63 by rotationally driving the driving motor 51 in the clockwise direction (i.e., the second direction), teeth 57*a* of the second planet gear 57 press against teeth 63*a* of the intermediate-transfer-belt drive gear 63 in a direction substantially orthogonal to the line L1 connecting the center O of the sun gear 55 and the center O1 of the second planet gear 57, thereby slightly rotating the intermediate-transfer-belt drive gear 63 in the reverse direction (i.e., the counterclockwise direction). Therefore, when the second planet gear 57 moves away from the intermediate-transfer-belt drive gear 63, the intermediate-transfer-belt drive gear 63 rotates in the reverse direction so that the intermediate transfer belt 21 rotationally driven by the belt support roller 23 moves in the opposite direction. Thus, the surface of the intermediate transfer belt 21 moves upstream in the moving direction of the intermediate transfer belt 21, which is a direction in which the intermediate transfer belt 21 moves away from an edge of the cleaning blade 27*a* of the belt cleaning device 27 that cleans the intermediate transfer belt 21. Consequently, due to the first intermediate gear 59 meshing with the intermediate-transfer-belt drive gear 63 and rotationally driving the intermediate transfer belt 21 in the normal direction, extraneous matter, such as paper particles from the recording paper 7, accumulated at the edge of the cleaning blade 27*a* may be removed by the edge of the cleaning blade 27*a* of the belt cleaning device 27.

As described above, in the image forming apparatus 1 according to the first exemplary embodiment, the black and color photoconductor drums 11 (Y, M, C, and K) and the intermediate transfer belt 21 are rotationally drivable selectively by a single driving motor 51 so that the number of driving sources may be reduced, thereby allowing for cost reduction.

Furthermore, in the image forming apparatus 1 according to the first exemplary embodiment, the drive gears 62 (Y, M, C, and K) that rotationally drive the black and color photoconductor drums 11 (Y, M, C, and K) are in a constantly meshed state via the transmission gears 63KC, 63CM, and 63MY. Therefore, the image forming apparatus 1 may prevent the phases of the black and color photoconductor drums 11 (Y, M, C, and K) from shifting and may readily and reliably match the phases of the black and color photoconductor drums 11 (Y, M, C, and K), whereby the occurrence of, for example, color misregistration in an image may be suppressed.

Second Exemplary Embodiment

Figure 6A:
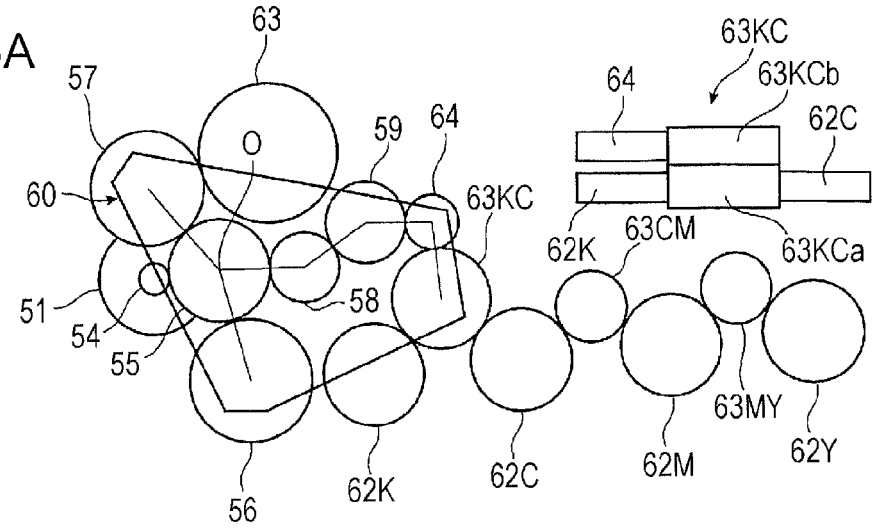
FIGS. 6A to 6C illustrate the configuration of the driving device of the image forming apparatus according to a second exemplary embodiment of the present invention.
Figure 6B:
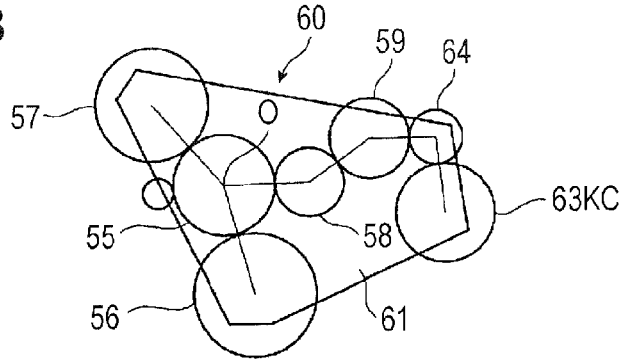
Figure 6C:
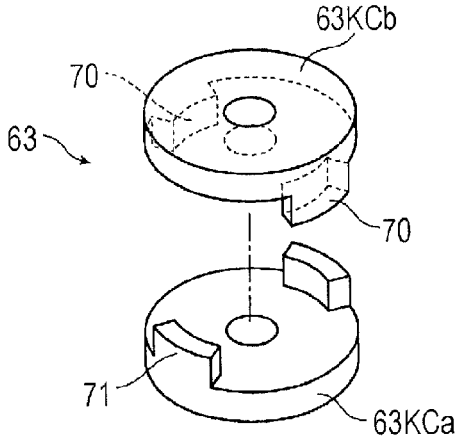

FIGS. 6A to 6C illustrate the driving device 50 of the image forming apparatus 1 according to a second exemplary embodiment.

As shown in FIGS. 6A to 6C, in the driving device 50 of the image forming apparatus 1 according to the second exemplary embodiment, the gear unit 60 having the frame 61 is configured such that the first intermediate gear 59, the second intermediate gear 64, and the transmission gear 63KC are in a constantly meshed state instead of the first intermediate gear 59 being selectively meshable with the second intermediate gear 64, and the transmission gear 63KC is disposed in a selectively meshable manner with the black and cyan photoconductor-drum drive gears 62K and 62C. Therefore, the second intermediate gear 64 and the transmission gear 63KC are provided in addition to the first intermediate gear 59 as gears attached to the gear unit 60. As shown in FIG. 6A, the transmission gear 63KC used has, for example, an outside diameter that is equal to those of the black and cyan photoconductor-drum drive gears 62K and 62C.

Furthermore, the transmission gear 63KC is constantly meshed with the second intermediate gear 64 and selectively meshes with the black and cyan photoconductor-drum drive gears 62K and 62C. Therefore, as shown in FIGS. 6A and 6C, the transmission gear 63KC includes identical gears 63KCa and 63KCb that are disposed in a double-layered fashion, and a slip area extending in the circumferential direction is provided between protrusions 70 and 71 that transmit a rotational driving force of the double-layered gears 63KCa and 63KCb. Thus, even in the state where the transmission gear 63KC is meshed with the second intermediate gear 64, the other one of the double-layered gears 63KCa and 63KCb slips in the circumferential direction so as to readily detach from the black and cyan photoconductor-drum drive gears 62K and 62C.

Operation of Characteristic Part of Image Forming Apparatus

Figure 7A:
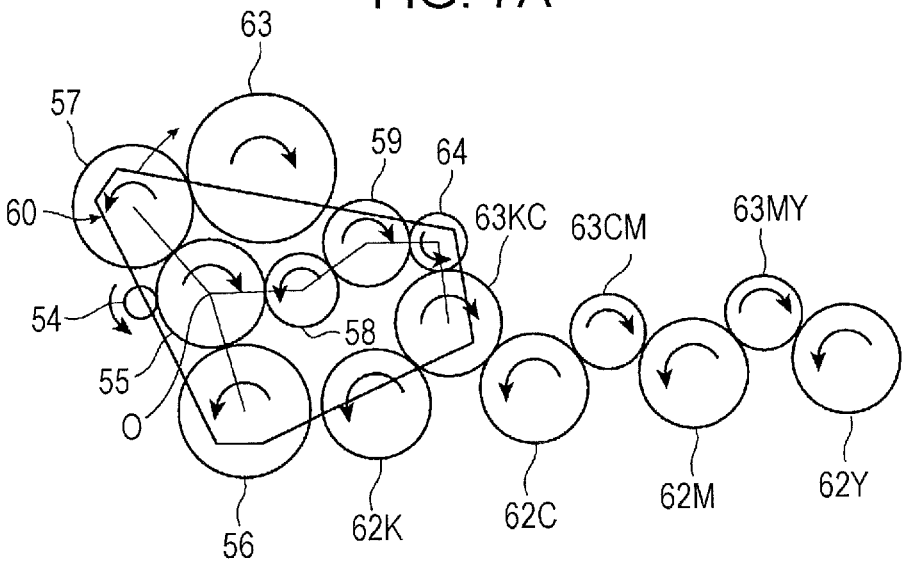
FIGS. 7A and 7B illustrate the operation of the driving device.

In the image forming apparatus 1 according to the second exemplary embodiment, in a case where the full-color mode is selected by the user, the controller 5 rotationally drives the driving motor 51 in the counterclockwise direction (i.e., the first direction). When the driving motor 51 is rotationally driven in the counterclockwise direction, the sun gear 55 meshed with the output gear 54 of the driving motor 51 rotates clockwise, as shown in FIG. 7A, causing the gear unit 60 to also rotate clockwise. As a result, the first planet gear 56 moves away from the black photoconductor-drum drive gear 62K, the second planet gear 57 meshes with the intermediate-transfer-belt drive gear 63, and the transmission gear 63KC meshes with the black and cyan photoconductor-drum drive gears 62K and 62C.

Therefore, the intermediate-transfer-belt drive gear 63 receives the rotational driving force from the output gear 54 via the sun gear 55 and the second planet gear 57, so that the intermediate transfer belt 21 is rotationally driven in the clockwise direction. Furthermore, the black and color photoconductor drums 11 (Y, M, C, and K) are rotationally driven in the counterclockwise direction via the output gear 54, the sun gear 55, the third planet gear 58, the first and second intermediate gears 59 and 64, and the transmission gear 63KC.

Accordingly, the image forming apparatus 1 rotationally drives the driving motor 51 in the counterclockwise direction so as to rotationally drive the black and color photoconductor drums 11 (Y, M, C, and K) and the intermediate transfer belt 21, thereby forming a full-color image.

Figure 7B:
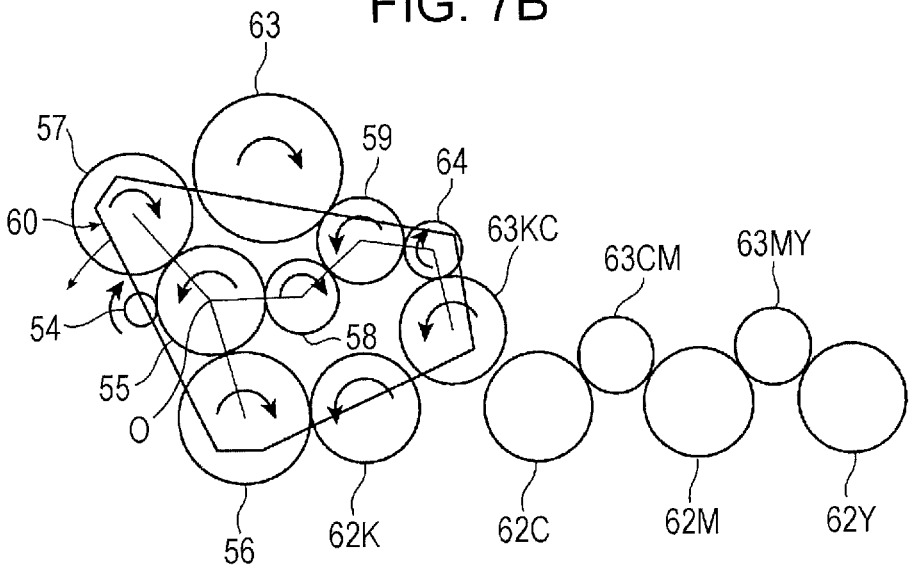

On the other hand, in the image forming apparatus 1, in a case where the monochrome mode is selected by the user, the controller 5 rotationally drives the driving motor 51 in the clockwise direction. By rotationally driving the driving motor 51 in the clockwise direction, the sun gear 55 meshed with the output gear 54 of the driving motor 51 rotates counterclockwise, as shown in FIG. 7B, causing the gear unit 60 to also rotate counterclockwise. As a result, the first planet gear 56 meshes with the black photoconductor-drum drive gear 62K, the second planet gear 57 moves away from the intermediate-transfer-belt drive gear 63, and the first intermediate gear 59 meshes with the intermediate-transfer-belt drive gear 63.

Therefore, the intermediate-transfer-belt drive gear 63 receives the rotational driving force from the output gear 54 via the sun gear 55, the third planet gear 58, and the first intermediate gear 59, so that the intermediate transfer belt 21 is rotationally driven in the clockwise direction. Furthermore, the black photoconductor drum 11K is rotationally driven in the counterclockwise direction directly by the photoconductor-drum drive gear 62K that receives the driving force from the output gear 54 via the sun gear 55 and the first planet gear 56. On the other hand, with regard to the color photoconductor drums 11 (Y, M, and C), the gear unit 60 rotates counterclockwise so as to cause the transmission gear 63KC to move away from the black and cyan photoconductor-drum drive gears 62K and 62C, whereby the color photoconductor-drum drive gears 62C, 62M, and 62Y are in a stopped state due to not receiving a rotational driving force.

Accordingly, the image forming apparatus 1 rotationally drives the driving motor 51 in the clockwise direction so as to rotationally drive the black photoconductor drum 11K and the intermediate transfer belt 21, thereby forming a monochrome image.

Furthermore, in the second exemplary embodiment, the second intermediate gear 64 and the transmission gear 63KC are attached to the gear unit 60, as shown in FIGS. 6A to 6C, so that the one-way clutch 65 may be omitted from the transmission gear 63KC, thereby allowing for further cost reduction as compared with the first exemplary embodiment.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of image bearing members that bear formed images;

a driving source that rotationally drives the plurality of image bearing members and whose rotational direction is switchable between a first direction and a second direction;

a first driving-force transmitting unit that transmits a rotational driving force of the driving source rotationally driven in the first direction as a unidirectional rotational driving force to the plurality of image bearing members; and a second driving-force transmitting unit that transmits a rotational driving force of the driving source rotationally driven in the second direction as a unidirectional rotational driving force to one or more of the plurality of image bearing members and does not transmit the rotational driving force to a remaining one or more of the plurality of image bearing members, wherein the first and second driving-force transmitting units are switched therebetween by changing the rotational direction of the driving source.

2. The image forming apparatus according to claim 1, wherein the first and second driving-force transmitting units include a gear mechanism constituted of a plurality of planet gears disposed around a sun gear.

3. The image forming apparatus according to claim 2, wherein a frame member that surrounds the planet gears and that rotates together with the planet gears by receiving the rotational driving force of the driving source is provided, wherein a rotational direction of the frame member is changed by switching the rotational direction of the driving source between the first direction and the second direction, and wherein gears to be meshed within the frame member and gears to be meshed outside the frame member in a stopped state change between when the rotational driving force in the first direction is received and when the rotational driving force in the second direction is received, so that the first and second driving-force transmitting units are switched therebetween.

4. The image forming apparatus according to claim 1, wherein one of the plurality of image bearing members is an intermediate transfer body, wherein a cleaning member that comes into contact with a surface of the intermediate transfer body so as to clean the surface is provided, and wherein the intermediate transfer body rotates in a normal direction and a reverse direction during switching between the first and second driving-force transmitting units.

5. The image forming apparatus according to claim 4, wherein the first and second driving-force transmitting units are configured such that an angle formed between a line, which connects a center of a sun gear to a center of a planet gear that transmits a driving force to the intermediate transfer body, and a line, which connects the center of the planet gear to a center of the intermediate transfer body, is set to 90 degrees or smaller.

6. The image forming apparatus according to claim 1, wherein one of the plurality of image bearing members is a black-color image bearing member, and wherein, of the first and second driving-force transmitting units that transmit a driving force to the black-color image bearing member, one of the driving-force transmitting units transmits a driving force to a plurality of color image bearing members.

7. The image forming apparatus according to claim 1, wherein one of the first and second driving-force transmitting units includes a one-way clutch.

* * * * *